US005794514A

United States Patent [19]

Pecorari

[11] Patent Number: 5,794,514

[45] Date of Patent: Aug. 18, 1998

[54] VOLUMETRIC MACHINE WITH CURVED LINERS

[75] Inventor: Felice Pecorari, Campogalliano, Italy

[73] Assignee: S.A.I. Societa' Apparecchiature Idrauliche S.p.A., Italy

[21] Appl. No.: 860,988

[22] PCT Filed: Jan. 19, 1996

[86] PCT No.: PCT/IT96/00015

§ 371 Date: Jul. 10, 1997

§ 102(e) Date: Jul. 10, 1997

[87] PCT Pub. No.: WO96/22463

PCT Pub. Date: Jul. 25, 1996

[30] Foreign Application Priority Data

Jan. 19, 1995 [IT] Italy ..... MO95A0011
May 17, 1995 [IT] Italy ..... MO95A0078

[51] Int. Cl.[6] ..... F01B 3/00

[52] U.S. Cl. ..... 92/71; 92/57; 92/179; 92/129; 91/499; 417/269

[58] Field of Search ..... 92/12.2, 57, 71, 92/129, 120, 179; 417/269; 91/499

[56] References Cited

U.S. PATENT DOCUMENTS

| | | | |
|---|---|---|---|
| 2,329,480 | 9/1943 | Neuland . | |
| 2,691,348 | 10/1954 | Gunther | 92/57 |
| 3,281,065 | 10/1966 | Chaffiotte | 92/120 |
| 3,762,276 | 10/1973 | Gates | 92/57 |
| 3,945,348 | 3/1976 | Balve | 92/120 |
| 4,138,930 | 2/1979 | Searle | 92/57 |
| 5,249,506 | 10/1993 | Willimczik | 91/499 |
| 5,636,561 | 6/1997 | Pecorari | 91/499 |

FOREIGN PATENT DOCUMENTS

| | | |
|---|---|---|
| 1106980 | 12/1955 | France . |
| 1408719 | 12/1965 | France . |
| 94/10442 | 5/1994 | WIPO . |

*Primary Examiner*—Thomas E. Denion
*Attorney, Agent, or Firm*—Lerner, David, Littenberg, Krumholz & Mentlik

[57] ABSTRACT

Apparatus is disclosed for articulating and correcting the trajectory of a piston in a volumetric machine with a plurality of pistons in a plurality of corresponding curved cylinders. The apparatus includes a piston seal ring positioned in a plane inclined to a plane of rotation of the pistons, with the inclined plane being different for each of the pistons and an intersection point of the axis of rotation of the pistons and an axis of rotation of the cylinders, a position compensation element permitting movement of the selected piston tangential to an instantaneous trajectory of that piston, and a piston support in radial contact with that piston to compensate centrifugal forces acting on that piston.

18 Claims, 7 Drawing Sheets

VOLUMETRIC MACHINE WITH CURVED LINERS

FIELD OF THE INVENTION

The present invention concerns: articulation of the pistons with correction of the trajectories, prevalent unloading of the thrust from the pistons and seal system with compensated ring, that is connection devices of the pistons of volumetric machines with curved cylinder liners to their relative rotating supports, to compensate for the deviations in trajectory, due to their rigid assembly, that arise at the intermediate angles of rotation of 45°, 135°, 225°, and 315° during the rotation through one complete revolution, within and in combination with the inclined block of liners to a significant degree with respect to the average at the maximum displacement; articulation of the pistons of volumetric machines with crank mechanism or with curved liners that reduces the thrust of the fluid acting on the piston to a minimum, and, furthermore, an improved sealing system with compensated ring with recovery of wearing and of the manufacturing imperfections of the liner, in volumetric machines in general.

BACKGROUND OF THE INVENTION

Prior art relevant to the present invention comprises the pistons of volumetric machines with curved liners as described in patent application (WO94/10442), where three types of piston are described: piston for endothermic engines or for gaseous fluids with a high angle of inclination, coupled to the extremities of the engine shaft by means of gudgeons arranged radially at the centre of curvature of the trajectories; piston rigidly connected to the relative support plate; pistons with rigid stem and a spherical coupling with oscillating clearance on the screw with semi-spherical head, positioned in axis with the stem of the piston. Said first type show the seal rings that are not positioned in the plane of rotation of the pistons, but in an inclined plane, different for each piston, containing the centre of intersection of axis of rotation of the pistons and of the liner block.

Prior art also comprises articulations of the pistons of volumetric machines, with crank mechanism, of the known type with gudgeons or spherical couplings between the piston and the connecting rod.

Prior art solutions, however, do not permit a satisfactory transmission of the thrust generated by the fluid on the connecting rod or support element and, in the case of machines with curved liners, a satisfactory simultaneous compensation of the errors in the paths of the trajectories at the intermediate angles of rotation, 45°, 135°, 225°, and 315°: the correction has to occur in a direction which is tangential to the trajectory of the piston, that is, perpendicular to the radial direction.

At the same time as the said correction it is also necessary to compensate the centrifugal load acting on the piston that is free to oscillate, in order to prevent it from sliding against the internal surface of the curved liner: this causes both a rapid deterioration of the seal rings and an ovalisation of the liner. The combined effect of the error in the trajectory and of the centrifugal load is not compensated by any of the prior art pistons; at least one oscillating element is present in all of these: the piston on the gudgeon, the seal ring on the piston or the head of the piston on the stem that does not completely counteract the said combined effect. Volumetric machines with curved liners obtained with the said solutions have a high degree of wearing of the curved liner, short lifetime of the fluid seal and excessive noise levels due to the clearance required for the oscillation.

Prior art also comprises various types of seals in all kinds of materials, split rings, with clearance recovery with separate internal elastic elements or due to their elastic properties, though always requiring the arrangement of a plurality of rings, each in its own seat, in the sealing surface and/or with a limited capacity for recovering wearing and/or manufacturing clearances in the liner-piston coupling.

Prior art, therefore, has considerable limitations as regards improving the sealing and the articulations in volumetric machines with crank mechanism; there are also considerable limitations as regards the exploitation of the potential capabilities of volumetric machines with curved liners, due to their intrinsic better balancing with respect to preceding machines, and due to the exploitation of the evolution of the piston within the liner without contact between the side of the piston and the said liner.

Such prior are may be subject to considerable improvement with a view to eliminating the said drawbacks.

From the foregoing emerges the need to resolve the technical problem of inventing: a way of articulating the piston on the respective stem enabling it, in volumetric machines with curved liners, to carry out displacements that are tangential to the trajectory and oscillations on the radial axis, but with the possibility of preventing displacements that are radial with respect to the axis of rotation; a way of articulating the piston on the respective stem, or, for in crank mechanisms, on the connecting rod, achieving a more direct transfer of the thrust of the fluid; a seal system that enables contact to be maintained with the surface of the liner even with high levels of wearing and/or large manufacturing clearances.

SUMMARY OF THE INVENTION

The invention resolves the said technical problem by adopting: articulation of the pistons with correction of the trajectories, for volumetric machines with curved liners, comprising the seal ring of the piston not positioned in the plane of rotation of the pistons, but in an inclined plane, different for each piston, containing the centre of intersection of the axis of rotation of the pistons and of the liner block, characterised in that it has sliding and/or oscillating elements in a direction which is tangential to the instantaneous trajectory of the piston and has elements in radial contact between the piston and its relevant support means, i.e. stem or spherical support or extremity, to compensate the centrifugal forces acting on the mass of the piston.

The present invention also comprises constituting the said sliding elements a plane which is parallel, at the dead-centre positions, with the said plane of rotation of the pistons, fashioned inside the piston and on which slides a means made to oscillate on an axis which radial with respect to the axis of rotation of the pistons.

The present invention also comprises constituting the said oscillating elements, a spherical surface coupled with the piston positioned at the intersection between the plane of rotation of the pistons and the axis of the piston itself, coinciding with the tangent to the axis of the curved liner.

The present invention also comprises a piston coupled, internally, so that it slides with spacer parallelepiped, in turn coupled so that it oscillates on the extremity of the engine shaft: an elastic element is placed inside a radial hole of the said extremity which act on the lower part of the said piston, by means of a semi-cylinder with the convex part facing towards the piston, so as to keep the sliding surface in contact with the surface of oscillation between the piston and the extremity of the shaft.

The present invention also comprises the said elastic element consisting of a plate spring with flexibility limited by the conformation of the said radial hole, conveniently shaped or with two diameters; the spring is kept in place by an internal axial safety ring assembled in the lower part of the said piston.

The present invention also comprises a piston coupled to the prismatic stem by means of a semi-cylinder whose plane slides on the said internal plane of the piston and the curved surface, with a radial axis of curvature, with concave side facing towards the piston; the said piston has an internal lower protruding bulge, with centre of curvature coinciding with the semi-cylinder, kept in position by a retaining ring under the action of the axial clearance recovery spring: the internal sides of the piston are inclined in a direction which is tangential to the trajectory to permit the piston to be inclined with respect to the prismatic stem.

The present invention also comprises a hollow sphere piston coupled to a spherical support and kept in position there so that it may slide by means of a cap of the fixing screw; an annular zone with eccentric sphere with respect to the centre of curvature; the screw has an intermediate shank for the admission of the edges of the central hole; a lower stretch of the piston with rake angle greater than the semi-inclination of the block of curved liners; the piston is advantageously made of a plastic or other similar material, suitable for the type of fluid used.

The present invention also comprises a piston with spherical support surface oscillating on the spherical head of the prismatic stem, kept in position by two ledges positioned in the lower part of the said piston, which in turn are in contact with the protrusions of an annular spring positioned between the ledges and the head; two flexing chambers in the said head corresponding with the protrusions and the ledges; the sides of the ledges are inclined to facilitate assembly.

The present invention also comprises the curvature of the sides of the piston in a tangential direction having a radius which is less than the radius of the liners; in a radial direction with the major and minor radius of curvature equal to that of the curved liner.

The present invention also comprises a head of the stem, coupled to the piston with oscillation on a radial axis contained in plane normal to axis of the said drive shaft; the central axis of the piston intersecting the said plane correspondingly with said radial axis; a bevel on the stem on whose head the piston is coupled, in spherical contact on said plane and oscillating on the said stem on radial axis; an external spherical surface of the piston, with oscillating coupling with an analogous surface of the piston-support plate; a Belleville washer for taking up the clearance between said head and the piston, by means of spherical support ring.

The present invention also comprises in combination, or not, with the said articulations, in volumetric machines with curved liners: an articulation for volumetric machines with prevalent unloading of the thrust from the pistons, comprising the piston with spherical coupling to the load transmission element, characterised in that the said load transmission element is directly exposed to the pressure of the fluid over an area which is much greater than that to which the piston is exposed; an elastic element is positioned between, even using a ring with a semi-spherical cap, between the said piston and the said load transmission element, to close any clearance.

The present invention also comprises for volumetric machines for gases, the position of the seal ring between the piston and the liner in a position behind the spherical coupling with the load transmission element.

The present invention also comprises for volumetric machines for liquids, the position of the seal ring between the piston and the liner in a position behind the spherical coupling with the load transmission element.

The present invention also comprises the said elastic element advantageously consisting of a Belleville washer.

The present invention also comprises in machines with curved liners: the piston coupled to the piston support plate with spherical coupling and with radial support on a bevel on the stem to compensate the radial thrust.

The present invention also comprises in volumetric machines in combination, or not, with the said articulations of the pistons: a seal system with compensated ring, comprising rings with an elastic return, characterised in that the said rings have at least two internal symmetrical protuberances, of which half of them having an incision towards the outside; a pair of rings is assembled in a single seat with the rings arranged specularly with respect to the axis of symmetry so as to cover the protuberance/s with incision with that/those without incision; the rings may be broken in order to facilitate assembly in seats that may not be dismantled, but in a position that is removed from the zone of the protuberances and from the axis of symmetry.

Also adopting: the arrangement of the protuberances concentrated prevalently on a stretch of ring; the eccentricity arising being on the said axis of symmetry.

Also adopting: the depth of the protuberances and of the incisions being proportional to the said eccentricity.

Also adopting: a lining of low friction material securely anchored to the external diameter.

The advantages obtained with this invention for volumetric machines with curved liners are: the recovery of clearances enables the noise generated in passing the dead centre positions to be eliminated, in as much as the clearances are recovered automatically by the articulation; the reaction of the piston support against centrifugal forces enables the elimination of the wearing of the liners and of the seal rings; it is possible to use larger angles of inclination of the piston with respect to the liner block, so enabling volumetric machines with larger displacements to be obtained; it is possible to achieve improved balancing in the presence of a variable and rotating distribution; the radial forces of inertia acting on the piston are compensated entirely; the variety of solutions proposed enables all design requirements to be satisfied in relation to the required displacements and fluids employed.

The distribution of the pressure of the fluid, furthermore, in function of the surface exposed to it, enables the thrust on the piston to be reduced, thereby reducing the load on the oscillating surfaces; in this way, the seals, the oscillating surfaces and the piston, being subjected to lower loads, have a longer lifetime.

Also, the lower loads on the components that have reciprocal motion with respect to each other, reduce wearing and enable, without the use of special low friction materials, a significant reduction in the internal friction of the mechanism and a longer lifetime of the volumetric machine.

The advantages, finally, are: in the compensated sealing system the ring, with its elastic recovery, enables the variations in the diameter of the liner to be absorbed and to compensate for manufacturing tolerances between the piston and the liner that are not necessarily very small; wearing is prevalent in the seal rings, however, with the ring with a low friction coating, it is only the liner that is subject to wear and the ring is able to compensate for up to a 1% increase in the diameter before the assembling cut opens; the pair of seal rings, finally, superimposed so that the internal protuberances with the incisions cover those without incisions, guarantees the necessary fluid seal for the operation of volumetric machines; the isolation of the fluid chamber is considerably greater in that this sealing system does not function as with the labyrinth systems, the isolation being total due to the positioning of the two rings. Moreover, the rings carry out an accurate scraping action removing impurities from the surface of the liner.

BRIEF DESCRIPTION OF THE DRAWINGS

The nature of the present invention may be more fully appreciated with reference to the following detailed description, which, in turn, refers to the drawings in which.

DETAILED DESCRIPTION

Figure 1:
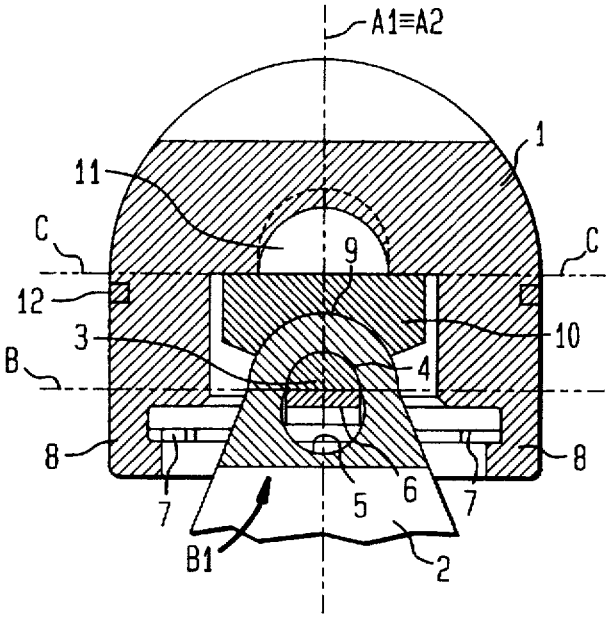
FIG. 1 is a side, sectional, elevational view of a piston used in accordance with the present invention taken along section I—I of FIG. 2.
Figure 2:
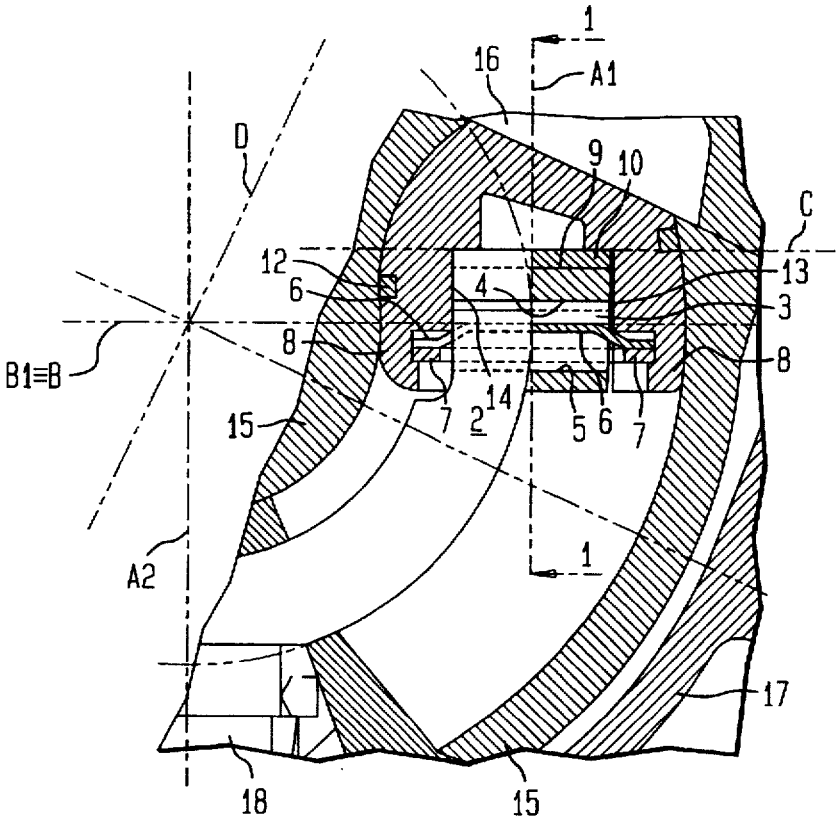
FIG. 2 is a front, partially sectional view of a curved liner with the piston shown in FIG. 1 for an endothermic engine or compressor in accordance with the present invention.

The figures show: 1, FIG. 1, the piston for endothermic engines or pneumatic machines, in the first form of embodiment, that has the central axis A1 coinciding, every half of a revolution, with the axis of the drive shaft A2 in FIG. 2, in the figure at the top dead centre position; 2, the extremity of the drive shaft on which the piston oscillates, on axis B1 at the crossing between the plane B with the said axis A1, by means of semi-cylindrical spacer 3 inserted by rotation in the upper minor diameter 4 of the two-diameter hole 5: the hole with the greater diameter is eccentric with respect to the axis of oscillation B1; 6, a plate spring, centrally in contact with flat surface of the said spacer 3, and externally resting on both sides on a safety ring 7 for holes, assembled in the lower part 8 of the said piston; 9, the upper semi-cylindrical surface of the extremity 2 of the drive shaft on which there is a parallelepiped spacer 10 with oscillating coupling on the same axis B1, in sliding contact with plane C, parallel to plane B, and internal to the said piston; 11, an internal cavity; 12, the seal ring; 13, FIG. 2, the clearance arising due to the centrifugal force between the external surface of the extremity 2, normal to axis B1, and the internal wall of the piston, whereas there is contact between the opposite surface 14 and the piston; 15 the block of curved liners rotating on axis D; 16 the combustion chamber; 17, the outer casing; 18 the drive shaft.

Figure 3:
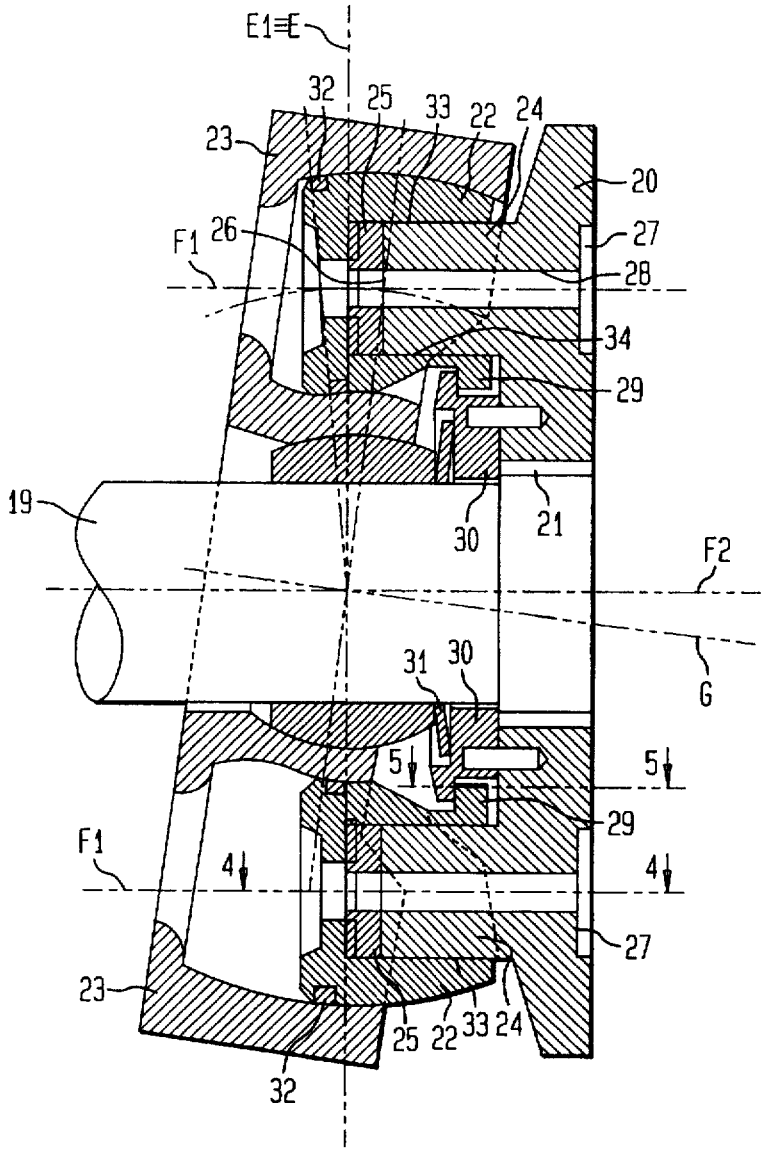
FIG. 3 is a side, elevational, sectional view of a piston-curved liner block for a hydraulic machine in accordance with another embodiment of the present invention.
Figure 4:
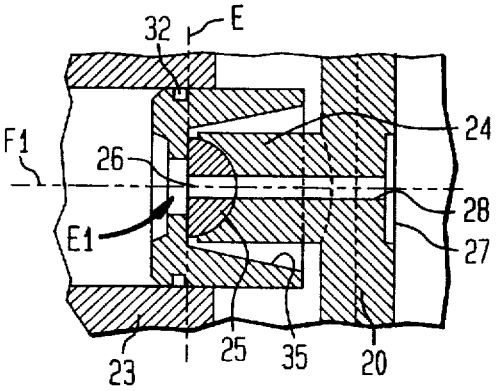
FIG. 4 is a side, elevational, sectional view of the piston and relative portions of a plate with stem taken along section IV—IV of FIG. 3.
Figure 5:
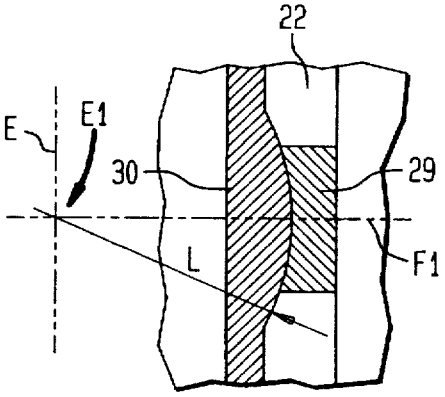
FIG. 5 is a partial, side, sectional view showing the zone of contact between the protuberance of the piston and the retaining ring taken along section V—V of FIG. 3.

The figures also show for the second form of embodiment for hydraulic fluids: 19, FIG. 3, the drive shaft, onto which is splined the piston support plate 20, by means of splined coupling 21; 22, the piston with prismatic stem, with oscillating coupling on radial axis E1 contained in plane E normal to axis F2 of the said drive shaft; F1 the central axis of the piston, intersecting with plane E in a position corresponding to that of E1; 23, the block with the curved liners, rotating on axis G; 24, the prismatic stem of the pistons, with semi-cylindrical spacer 25, in sliding contact with the top internal face of the said piston 22, plane E, and oscillating on the said prismatic stem 24 by means of the semi-cylindrical surface 26 with axis E1 as centre of curvature; 27, the bearing and 28, the feed channel, in stem 24, in the spacer 25 and in the piston 22, for the compensation of the hydraulic thrust; 29, an internal lower protrusion in the piston, with oscillating coupling with a retaining ring 30, in turn splined on the said piston support plate 20; 31, the Belleville washer for recovering the clearance between liner block 23 and said plate 20; 32, the seal ring of the said piston 22; 33 the clearance arising as a result of centrifugal forces between the external surface of the stem 24, normal to axis E1, and the internal wall of the piston, whereas there is contact between the opposite surface 34 and the piston; 35, FIG. 4, the inclined sides to enable the oscillation of the piston on said axis E1; L, FIG. 5 the radius of curvature between the said ring and the protuberance 29 of the piston 22.

Figure 6:
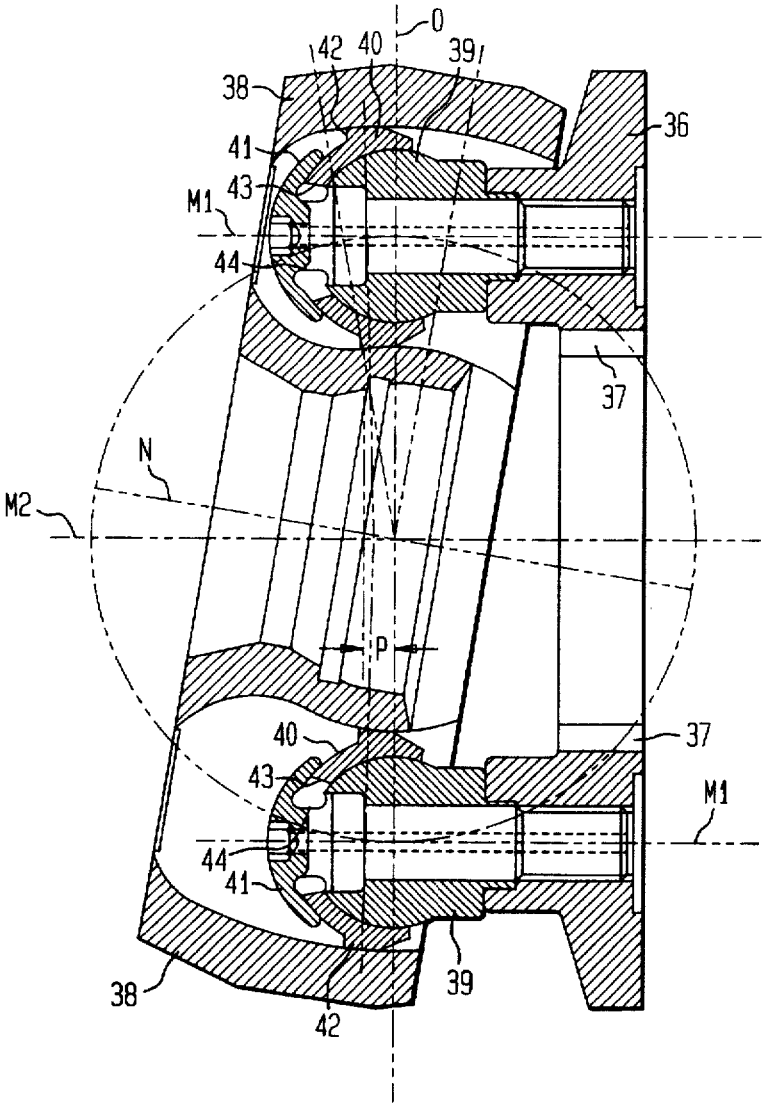
FIG. 6 is a side, sectional, elevational view of a piston-curved liner block group in accordance with another embodiment of the present invention for use in a medium or low pressure hydraulic device or pneumatic device.
Figure 7:
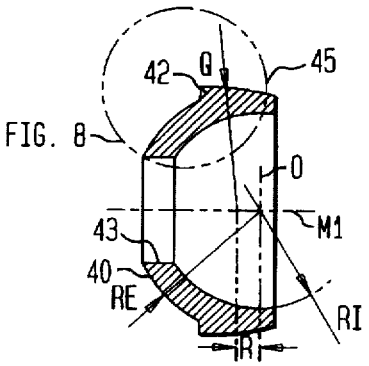
FIG. 7 is a side, partial, sectional view of the piston with hollow sphere and eccentric contact showing the radiuses and eccentricity of the device shown in FIG. 6.
Figure 8:
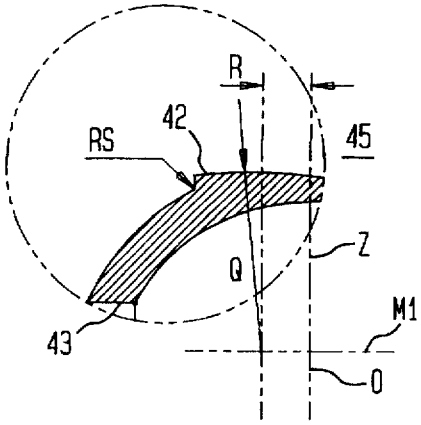
FIG. 8 is an enlarged, partial, sectional view of detail z of the piston shown in FIG. 7.

The figures also show: 36, FIG. 6, the piston-support plate in the third form of embodiment, coupled to the drive shaft with axis M2, with splined coupling 37; N, the axis of rotation of the liner block 38; 39, the spherical support for the hollow sphere piston 40 with eccentric contact, the support being splined to the said plate 36 and fixed with bolts 41 with spherical cap head: the bolts and the plate a drilled for the compensation of the hydraulic thrust; M1, the axis of symmetry of the piston, at whose crossing with plane O the sphere of oscillation of the piston 40 is positioned; 42, the annular, eccentric spherical zone of the said piston, moved by an amount P from the plane O; 43, a central upper hole of the piston 40, with rake angle which is greater than the semi-angle of inclination of the liner block 38; 44 an intermediate shank of bolt 41 for the admission of the edges of the said central hole 43; RI, FIG. 7, the radius of the internal sphere of oscillation of the piston 40; RE, the radius of the external sphere, coinciding with the internal radius of the spherical cap head of the bolt 41; R, the displacement from the plane O of the centre of curvature of the annular zone 42; Q, the radius of the said eccentric spherical annular zone 42; 45, the lower part of the piston 40 with rake angle greater than the semi-inclination of the said block 38; RS, the fillet between the external spherical surface of the piston 40 and the eccentric annular zone 42 for the admission of the said spherical cap of the bolt 41.

Figure 9:
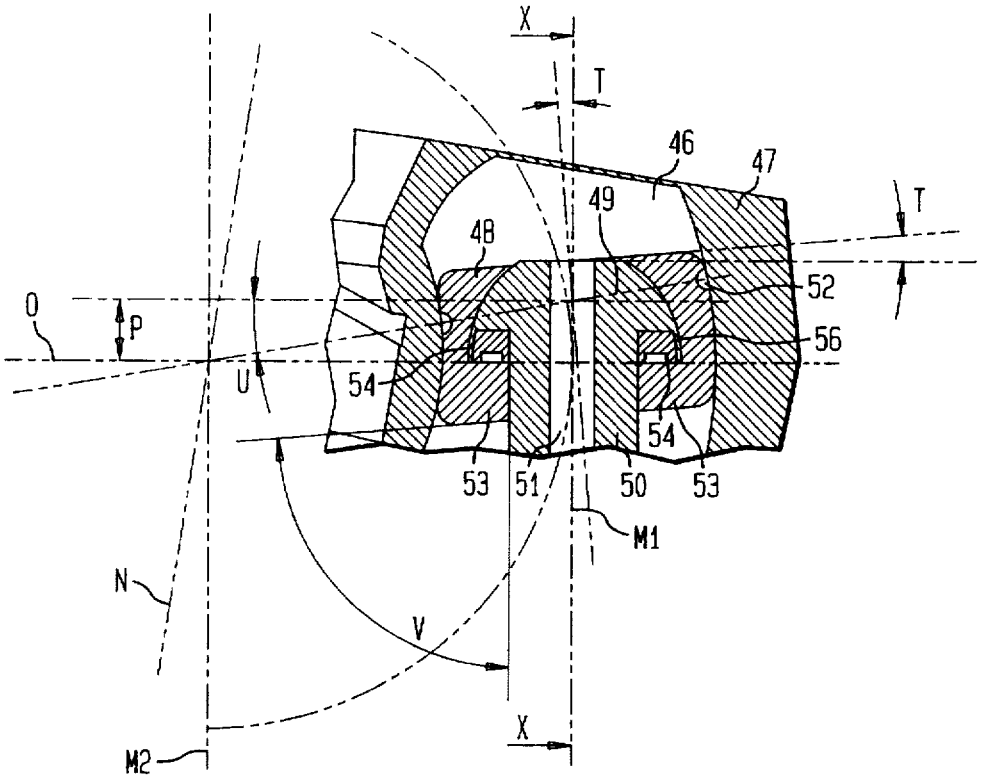
FIG. 9 is partial, side, elevational view of a piston in another embodiment of the present invention inside the curved liner in a median point of the stroke thereof.
Figure 10:
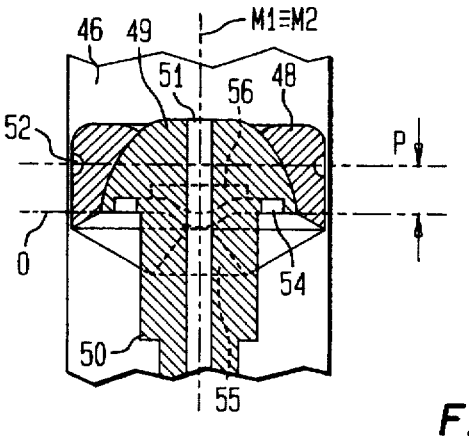
FIG. 10 is front, sectional view of the piston shown in FIG. 9 taken along section X—X thereof tangential to the trajectory at the top and bottom dead center points of the stroke thereof.
Figure 11:
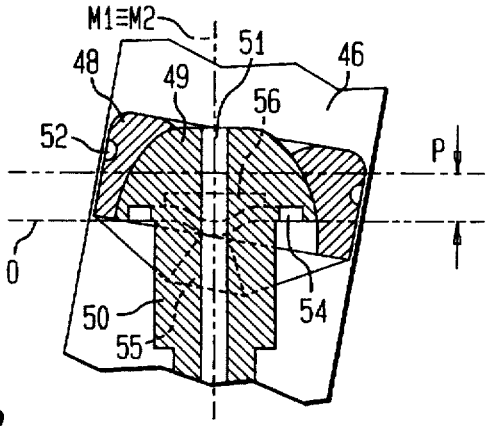
FIG. 11 is a front, sectional view of the piston shown in FIG. 10 in an intermediate point of the stroke thereof.
Figure 12:
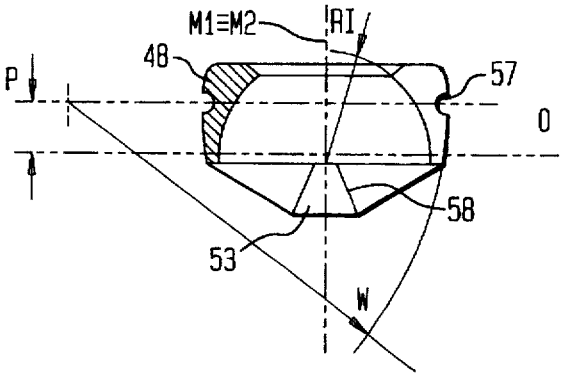
FIG. 12 is a partial, sectional view of the piston shown in FIG. 10 with spherical support.

The figures show, finally, in the fourth form of embodiment, the common references to the pervious form remaining valid: 46, FIG. 6, the curved liner fashioned in the block 47 rotating on axis N; 48, the piston with spherical support, oscillating on the spherical head of 49 of the prismatic stem 50; 51, the axial hole for the compensation of the hydraulic thrust; 52, the seal ring, positioned in a plane advanced by an amount P and inclined by an amount U with respect to the plane of oscillation O; 53, two lower shelves of the piston with spherical plane of contact, for retaining, by means of annular spring 54, between the said shelves and the said head 49, maintaining contact on the spherical surface; T, the positioning angle of the piston, corresponding to half the angle U; V, the complementary angle of U between the internal surface of the shelf and the base plane for machining the piston 48: the said surface rests on the internal side of the prismatic stem 50 of the piston with a view to compensating the centrifugal forces, in association with the contact on the spherical surface; 55, the protrusions of the annular spring resting on the said shelves with localised contact; 56, the flexing chamber of the stretches of annular spring, in correspondence with the said protuberances 55 and shelves 53; 57, FIG. 12, the seat of the seal ring on the said piston with spherical support; 58, the sides of the said shelves, inclined to facilitate assembly; W, the radius of curvature of the sides of the piston with spherical support surface in a direction which is tangential to the trajectory: the radiuses in a radial direction are shown in FIG. 9 and are equal to the major and minor radiuses of curvature of the liner.

Figure 13:
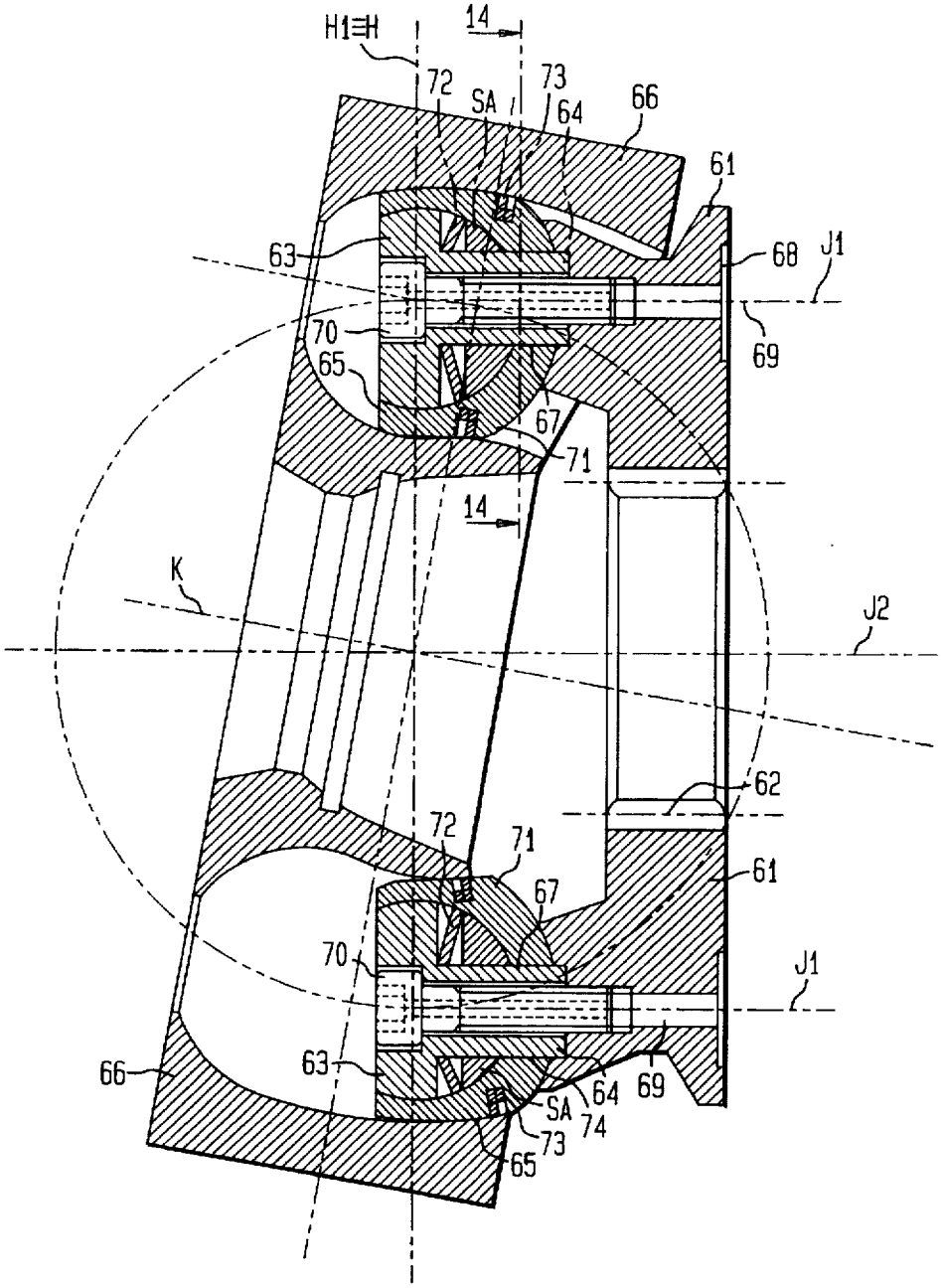
FIG. 13 is a side, sectional, elevational view of a piston-curved liner block group for a hydraulic machine in accordance with another embodiment of the present invention with articulation with prevalent unloading of the thrust thereof.

The figures also show, in the case of articulation with prevalent unloading of the thrust in volumetric machines with curved liners: 61, FIG. 13, the piston-support plate with splined coupling 62 with the drive shaft, not shown; 63, the bevelled head of the stem 64, coupled to the piston 65 with oscillation on radial axis H1 contained in plane H normal to axis J2 of the said drive shaft; J1, the central axis of the piston, intersecting the plane H correspondingly with axis H1; 66, the block with the curved liners, rotating on axis K; 67, the bevel on the stem 64 on whose head the piston 65 is coupled, in spherical contact on plane H and oscillating on the said stem 64 on axis H1; 68, the bearing compensating the axial thrust and the feed channel 69, in the piston-support plate 61, and in the drilled bolt 70 for the said bearing; 71, an external spherical surface of the piston 65, with oscillating coupling with an analogous surface of the piston-support plate 61; 72, the Belleville washer for taking up the clearance between the head 63 and the piston 65, by means of spherical support ring SA; 73, the pair of seal rings of the said piston 65; 74, the clearance arising from the centrifugal forces between the external surface of the stem 64, normal to axis H1, and the internal wall of the piston, whereas there is contact between the opposite surface 67 and the piston 65; 75, FIG. 14, the clearance between the internal sides to allow the oscillation of the piston on the said axis H1.

Figure 15:
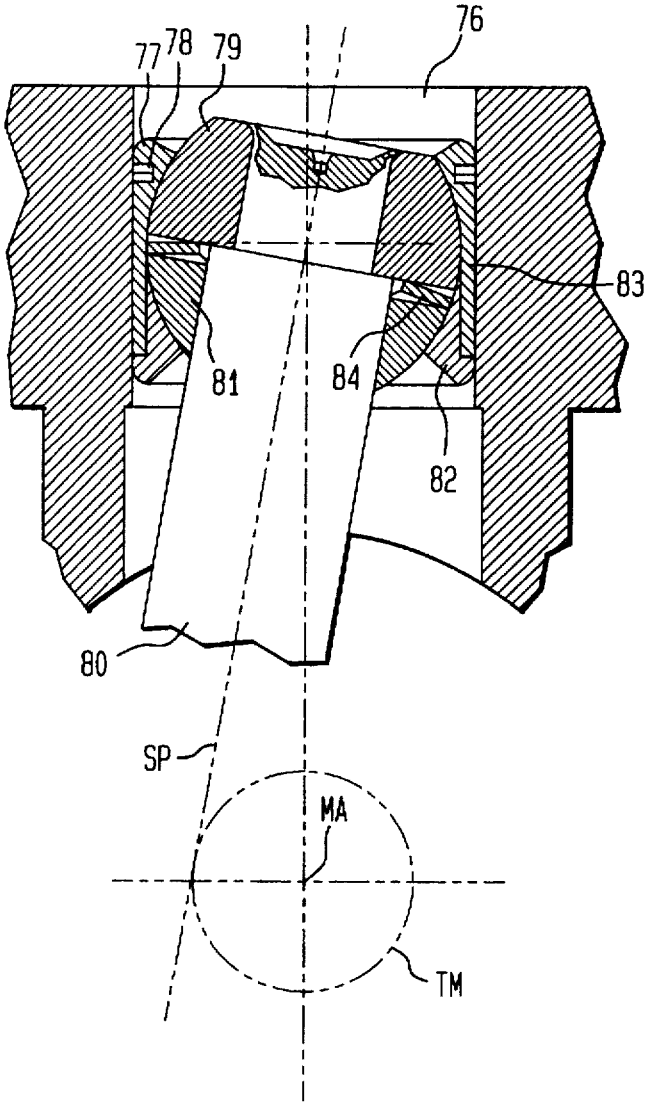
FIG. 15 is a partial, side, sectional view of a volumetric device with a crank mechanism with articulation and prevalent unloading of the thrust thereof according to another embodiment of the present invention.

The figures also show, in the case of the volumetric machine with crank mechanism: 76, FIG. 15, the straight liner within which the annular piston 77 slides, with spherical seat, with external seal ring 78; 79, the assembled spherical foot of the connecting rod 80, connected to the rotating crank on axis MA and with trajectory TM of the eccentric: the crank is not shown in the figure as it may be of any type; 81, the spherical annular cap, with a sliding coupling on axis SP with the stem and with the spherical surface of a lower ring 82 fixed to the said piston 77, by means of connection 83; 84, a Belleville washer to take up the clearance between the said foot 79 and the said annular cap 81.

Figure 16:
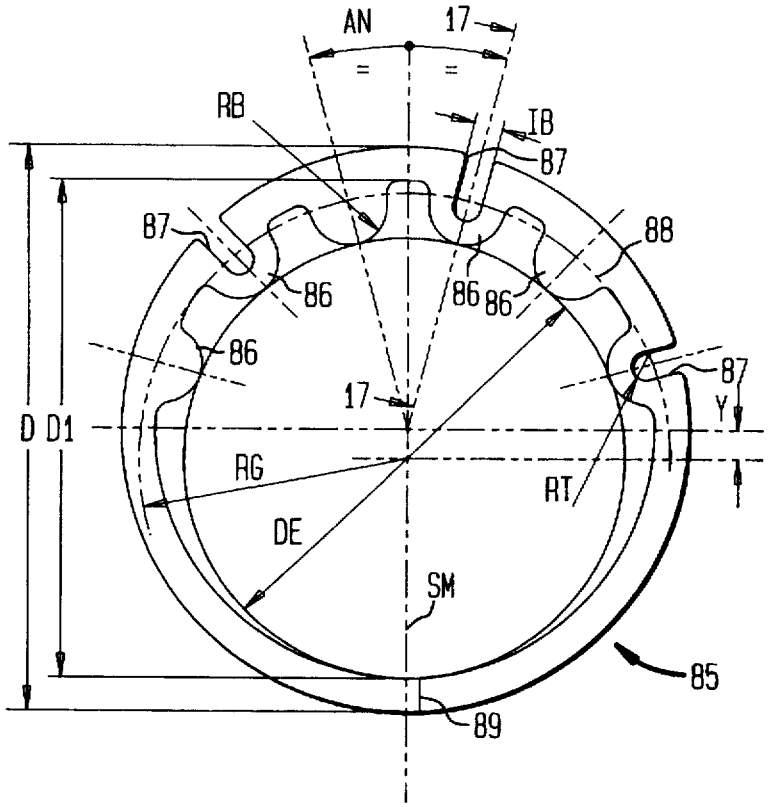
FIG. 16 is a top, elevational, sectional view of at piston seal ring used in accordance with the present invention.
Figure 17:
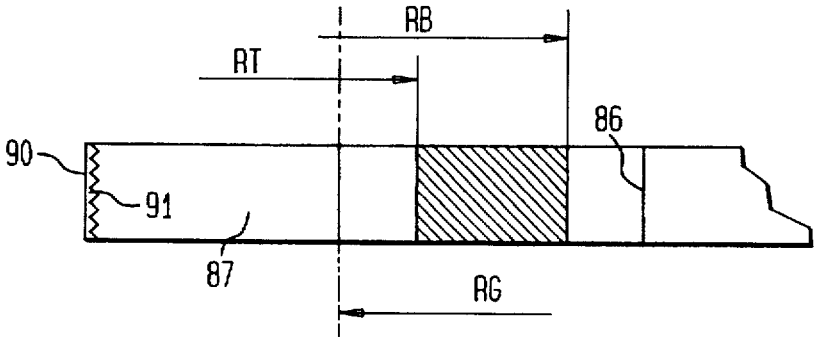
FIG. 17 is a partial, side, sectional view of the piston seal ring shown in FIG. 16 taken along section XVII—XVII thereof.

The figures also show, in the sealing system with compensated ring: 85, FIG. 16, the seal ring according to the invention, having internal protuberances 86, with or without incision 87; AN, the angle between two successive protuberances 86; SM, the axis of symmetry of the said protuberances: the incisions 87, of a width IB, are made in stretches of ring with protuberances that are not symmetrical with one another; RT, the radius at the base of the incisions, measured from the eccentric circumference RG, with an eccentricity Y on the said axis of symmetry SM; RB, the radius of the said protuberances; DE, the internal eccentric diameter, again by an amount Y, tangential to the internal diameter DI of the ring 85 and the innermost part of the protuberances 86; DC, the nominal diameter of the ring, equal to the nominal diameter of the liner for which it is intended; 89, the break in the seal ring made in order to permit its assembly in seats which may not be dismantled: it is positioned away from the zone of the protuberances 86 and not in line with the said axis of symmetry SM; 90, FIG. 17, a covering in low-friction material applied to the external side of the ring at the nominal diameter, in a peripheral hollow 91 with serrated surface for anchoring the covering.

Operation of the articulations described is as follows: the zone of contact and, therefore, that creating the seal between the piston and the liner, is displaced from the plane of rotation of the pistons (planes B, E and O); the seal ring (12, 32 and 52) or the annular zone 42 are positioned in a plane oriented towards the common centre of rotation of the liner block and of the pistons projected over the said plane of rotation of the pistons; the presence of planes of linear correction in a direction which is tangential to the trajectory of the pistons, plane C in the first form of embodiment, plane E in the second, and the slight variation in the inclination of the piston in the third and fourth forms, enables the actual position of the piston to be adapted to the combination of the respective positions between the curved liner and the piston. The correction angles of oscillation are small whereas the angles of oscillation to compensate for the inclination of the liner as it passes through the mid-stroke point need to be much higher, of the order of the maximum inclination that may be reached by the liner block: the said rotation occurs on surface 9 of the extremity 2 in the case of the first form of embodiment, on the surface of semi-cylindrical spacer 25 in the second form, and with an oscillation of the hollow sphere piston 40, or of the piston with spherical support 48 on the respective sphere 39 or 49. The radial loads on the piston, due to centrifugal forces, are compensated with the contact of a surface of the said piston against the stem on the internal side 14, 34, leaving, on the opposite, external side a clearance 13, 33 both between the stem of the piston and between the piston and the said liner; the loads acting on the hollow sphere piston, being made of a plastic, or similar, material very low due to the reduced mass, and, moreover the, extensive surface of contact with the spherical support 39 does not permit an effective action of the said centrifugal force. As mentioned earlier, in the fourth form of embodiment the piston 48 is supported with a double contact, both on the spherical head 49, and with the contact between the shelf 53 and the internal part of the prismatic stem 50. The elastic elements: the plate spring 6, the Belleville washer 31 and the ring spring 54 keep the relative piston in its position in contact with each surface of oscillation, preventing the separation of the piston, avoiding generating noise on inversion of the sense of rotation and/or of the thrust.

Figure 14:
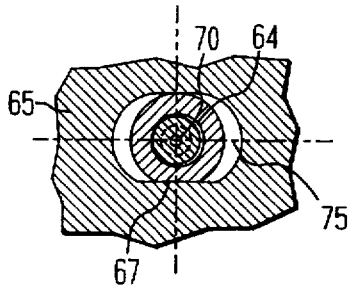
FIG. 14 is a partial, sectional view of the piston and relative stem of the device shown in FIG. 13 taken along section XIV—XIV thereof.

Operation of the articulation described with prevalent unloading of the thrust from the pistons, in the case of volumetric machine with curved liners, FIGS. 13 and 14, is as follows: the zone of contact and, therefore, that creating the seal between the piston and the liner, is displaced from the plane of rotation of the pistons, plane H; the seal rings 73 are positioned in a plane oriented towards the common centre of rotation of the liner block and of the pistons, in a rearward position with respect to said plane H of rotation of the pistons; the linear correction in a direction which is tangential to the trajectory of the pistons at the said angles of rotation 45°, 135°, 225° and 315°, in plane H, occurs because of the considerable tolerance left between the piston and the liner, whereas sealing occurs between the head 63 of the stem 64 and the internal spherical surface of the piston 65. The corrections are small, but in the lower part of the piston 65, where the pair of seal rings 73 are positioned, cause a significant amount of oscillation, compensated by clearance 75 between the piston and the stem 64 in a direction which is tangential to the trajectory of rotation.

The radial loads on the piston of machines with curved liners, due to centrifugal forces, are compensated by the contact of the internal surface of the said piston against the bevel 67 of the stem 64, leaving, on the opposite, outward side, clearance both between the stem of the piston and between the said piston and the said liner. The Belleville washer 72 keeps the respective piston 65 constantly in contact with the corresponding spherical seat of the piston-support plate 61, preventing the separation of the piston, avoiding generating noise on inversion of the sense of rotation and/or of the thrust. In this way the thrust of the fluid acts mostly on the head 63 of the stem 64 and only in small part on the piston 65, limited only to the surface of the annular crown exposed to the pressure: the lower positioning of the seal rings 73 favour, by means of the pressure of the fluid, the internal seal of the piston 65 with the spherical surface of the head 63. As a result the thrust generated by the fluid is transmitted directly to the component that makes use of its effect: the piston-support plate 61, by means of the said heads 63 rigidly fixed to it with respective stems 64. The thrust that the said piston 65 is subjected to, to favour the oscillations on the spherical surface 71, are minimal and enable the piston to operate with absolute fluid seal and compensation of trajectory even with the highest operating pressures without, moreover, increasing wearing of the piston, the liners and of the seal rings.

Operation of the articulation for volumetric machines with crank mechanism is analogous: the annular piston 77 oscillates on the assembled spherical foot 79 of the connecting rod 80 and, in its lower part, the annular spherical cap 81, acted on by spring 84, takes up the clearance against the lower ring 82 connected rigidly to the annular piston 77; the surface of connecting rod exposed to the pressure is much greater than the free annular surface of the piston 77, with, therefore, a considerable difference in relative loads to be supported; the seal between the assembled spherical foot 79 of the connecting rod and the piston 77 occurs at the said spherical surface; the oscillation between the foot 79 and the piston 77, which is equal to the angles of oscillation of the connecting rod 80, in function of its length and the trajectory TM of the eccentric, does not compromise operation because of the action of increased sealing effected, on the annular piston 77 and the spherical surface, by the pressure of the fluid: during operation without pressure, or with negative pressure, the spring 84 and the spherical annular cap 81, taking up any design clearance and possible wearing, prevents knocking and vibrations.

The assembly of the compensated seal ring according to the present invention is as follows: the ring 85 with protuberances 86, eccentric by an amount Y, is introduced into the seat with an analogous ring arranged in a mirrored position with respect to axis SM, so that the incisions 87 on one ring correspond with protuberances 86 on the other ring without incisions; introduction into seats that may not be dismantled is made possible by the cut 89 provided in the part of the ring opposite the protuberances; the angular positioning of the pair of seal rings 85 is ensured by the eccentricity Y and the corresponding eccentricity in the seat in the piston. Subsequently, the introduction of the piston with the pair of rings 85 occurs by overcoming the slight interference between the diameter DC of the ring and the effective diameter of the liner: the contraction required, to slightly reduce the diameter, occurs in the protuberances 86 provided with incisions 87 that operate as elastic elements; both the rings of the pair contract, but the reciprocal covering of the respective protuberances 86, with or without incision 87, arranged in mirrored positions, is not affected. Assembly of seal rings with protuberances arranged, not eccentrically, but along the entire internal diameter, is carried out in an analogous manner, but a means for preventing the rotation of the pair of seal rings has to be provided, as they always have to remain superimposed in a mirrored position, that is with the protrusions 86 provided with incision 87 coupled with protuberances 86 without incision. The recovery of clearance and wearing on the external diameter DC of the seal ring 85 occurs with the reduction of the contraction due to assembly with the said interference: the covering 90 with low friction material reduces wearing of the liner and of the seal rings to very low values, permitting a very long lifetime even with tolerances that are not very limited.

If in practice the materials, dimensions and operative details should be different from those indicated, but technically equivalent, the patent will still apply. So as the displacement P, for example, of the seal ring (12, 32, 52) can be negative, that is in an opposite position with respect to the plane of rotation of the pistons (B, E, or O), for a more precise balancing in hydraulic transmissions with variable and rotating distribution. Also, the spherical foot 79 of the connecting rod 80 and the connecting rod itself may be lightened in the known manner, so reducing reciprocating masses.

I claim:

1. An apparatus for articulating and correcting the trajectory of a predetermined piston in a volumetric machine having a plurality of pistons in a plurality of corresponding curved cylinders, said apparatus comprising:

(a) at least one piston seal ring associated with said predetermined piston, said at least one seal ring positioned in a plane inclined to a plane of rotation of said plurality of pistons, said inclined plane being different for each of said plurality of pistons and containing an intersection point of an axis of rotation of said plurality of pistons and an axis of rotation of said plurality of cylinders;

(b) a position compensation element permitting movement of said predetermined piston in a direction tangential to an instantaneous trajectory of said predetermined piston; and (c) a piston support in radial contact with said predetermined piston to compensate centrifugal forces acting on said predetermined piston.

2. An apparatus as claimed in claim 1, wherein said position compensation element comprises:

(a) a planar surface formed within said predetermined piston parallel with said plane of rotation of said plurality of pistons when said predetermined piston is at a top dead center position; and (b) an oscillating element in sliding contact with said planar surface for oscillation of said predetermined piston about an axis radial to said axis of rotation of said plurality of pistons.

3. An apparatus as claimed in claim 1, wherein said position compensation element comprises:

(a) a spherical surface coupled with said predetermined piston, said spherical surface having a center positioned at an intersection of said plane of rotation of said plurality of pistons and an axis of said predetermined piston;

(b) wherein said axis of said predetermined piston coincides with a tangent of an axis of an associated curved cylinder.

4. An apparatus as claimed in claim 2, wherein said position compensation element is a parallelepiped spacer in slideable engagement with said predetermined piston and in oscillatory engagement with an extremity of an engine shaft; said apparatus further comprising:

(a) a semi-cylindrical spacer located in a radial hole in said extremity, said semi-cylindrical spacer having a convex surface facing said predetermined piston; and (b) an elastic element located in said radial hole and acting between said semi-cylindrical spacer and a lower part of said predetermined piston, so as to maintain said slideable engagement and said oscillatory engagement.

5. An apparatus as claimed in claim 4, wherein said elastic element comprises a plate spring having flexibility limited by said radial hole; and wherein said apparatus further comprises an internal axial safety ring in said lower part of said predetermined piston for retaining said plate spring.

6. An apparatus as claimed in claim 2, wherein said predetermined piston support comprises a prismatic stem, and wherein said predetermined piston is coupled to said prismatic stem through a semi-cylinder having a planar surface in slideable engagement with said planar surface within said predetermined piston, said semi-cylinder further having a convex surface with a radial axis of curvature, said convex surface facing away from said predetermined piston and engaged with said prismatic stem; said apparatus further comprising:

(a) a protruding bulge on a lower portion of said predetermined piston, said bulge having a curved surface with a center of curvature coinciding with said radial axis of curvature of said convex surface of said semi-cylinder;

(b) a retaining ring contacting said curved surface of said bulge;

(c) an axial clearance recovery spring urging said retaining ring against said curved surface of said bulge; and (d) internal sides within said predetermined piston inclined in a direction tangential to said trajectory to permit said predetermined piston to be inclined with respect to said prismatic stem.

7. An apparatus as claimed in claim 1 or claim 3, wherein said piston support is a spherical support and said predetermined piston comprises a hollow sphere piston coupled to said spherical support; said apparatus further comprising:

(a) a fixing screw having a cap for slideably retaining said hollow sphere piston on said spherical support through a central hole in said hollow sphere piston; said fixing screw having an intermediate shank for clearing edges of said central hole;

(b) an eccentric annular spherical surface on said hollow sphere piston having a center offset from a center of said hollow sphere piston; and (c) a lower portion of said predetermined piston having a rake angle greater than one-half of an angle of inclination between said axis of rotation of said plurality of pistons and said axis of rotation of said plurality of cylinders.

8. An apparatus as claimed in claim 1 or claim 3, wherein said piston support comprises a prismatic stem with a spherical head; and wherein said predetermined piston comprises a spherical support surface for oscillating on said spherical head, and said predetermined piston further comprises two ledges on a lower portion of said predetermined piston for retaining said predetermined piston, said ledges having inclined sides for facilitation of assembly;

said apparatus further comprising an annular spring positioned between said ledges and said head, said spring having protrusions in contact with said ledges; and said spherical head having two flexing chambers for receiving said protrusions and ledges.

9. An apparatus as claimed in claim 8, wherein an outer surface of said predetermined piston has a radius of curvature in said tangential direction less than a radius of curvature of said plurality of cylinders, and major and minor radii of curvature in a direction radial to said axis of rotation of said plurality of pistons equal to major and minor radii of curvature, respectively, of said plurality of cylinders.

10. An apparatus as claimed in claim 1 or claim 3, wherein said piston support comprises a stem with a head, said head coupled to said predetermined piston through spherical contact centered in a plane normal to said axis of rotation of said plurality of pistons, for oscillation on a radial axis contained in said plane, wherein an axis of said predetermined piston intersects said radial axis in said plane; said apparatus further comprising:

a bevel on said stem for radial contact between said piston support and said predetermined piston;

an external spherical surface on said predetermined piston, slidably engaged with a corresponding spherical surface on said piston support; and a Belleville washer for urging said spherical surfaces of said predetermined piston and said piston support together through a spherical support ring positioned between said Belleville washer and said predetermined piston.

11. An apparatus as claimed in claim 1, claim 2 or claim 3, wherein said at least one piston seal ring comprises a pair of said piston seal rings assembled in a single ring seat in said predetermined piston, said pair of said piston seal rings comprising at least two internal protuberances arranged symmetrically about an axis of symmetry of said pair of said piston seal rings; every one of said protuberances having a corresponding incision extending inwardly from an external edge of said pair of said seal rings.

12. An apparatus as claimed in claim 11, comprising said pair of piston seal rings arranged specularly with respect to said axis of symmetry so that each protuberance with an incision in one of said pair of piston seal rings is in registry with a protuberance without an incision in the other of said pair of piston seal rings.

13. An apparatus as claimed in claim 12, wherein said protuberances are concentrated on a portion of said pair of piston seal rings; and wherein a resulting eccentricity is along said axis of symmetry.

14. An apparatus as claimed in claim 13, wherein a radial thickness of each said protuberance and a radial depth of each said incision are proportional to said eccentricity.

15. An apparatus as claimed in claim 13, wherein a lining of low friction material is securely anchored to said external edge.

16. An apparatus as claimed in claim 5 wherein said radial hole comprises a pair of diameters.

17. An apparatus as claimed in claim 7 wherein said hollow sphere piston is fabricated substantially of a plastic resin.

18. An apparatus as claimed in claim 12 wherein said pair of piston seal rings are broken in a position removed from said axis of symmetry and from said protuberances, whereby said piston seal rings may be assembled into said ring seat without dismantling said predetermined piston.

* * * * *

UNITED STATES PATENT AND TRADEMARK OFFICE

CERTIFICATE OF CORRECTION

PATENT NO. : 5,794,514

DATED : August 18, 1998

INVENTOR(S) : Pecorari

It is certified that error appears in the above-identified patent and that said Letters Patent is hereby corrected as shown below:

Column 1, line 27, after "application" insert --PCT/IT92/00134--.

Column 4, line 27, "Also adopting" should read --The present invention also comprises--.

Column 4, line 30, "Also adopting" should read --The present invention also comprises--.

Column 4, line 32, "Also adopting" should read --The present invention also comprises--.

Column 6, line 1, "of at piston" should read --of a piston--.

Signed and Sealed this

Fifteenth Day of December, 1998

Bruce Lehman

*Attest:*

BRUCE LEHMAN

*Attesting Officer*

*Commissioner of Patents and Trademarks*